US007710006B2

(12) United States Patent
Kyuno et al.

(10) Patent No.: US 7,710,006 B2
(45) Date of Patent: May 4, 2010

(54) SPARK PLUG

(75) Inventors: Jiro Kyuno, Aichi (JP); Toshitaka Honda, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 618 days.

(21) Appl. No.: 11/505,902

(22) Filed: Aug. 18, 2006

(65) Prior Publication Data

US 2007/0040487 A1 Feb. 22, 2007

(30) Foreign Application Priority Data

Aug. 19, 2005 (JP) ..... 2005-239176

(51) Int. Cl.
*H01T 13/00* (2006.01)

(52) U.S. Cl. ..... 313/144; 313/118; 313/137; 123/169 R; 123/169 E; 123/169 P

(58) Field of Classification Search ..... 313/118–145; 123/169 R, 169 E, 169 P; 445/7
See application file for complete search history.

(56) References Cited

U.S. PATENT DOCUMENTS

| | | | | |
|---|---|---|---|---|
| 6,111,345 | A * | 8/2000 | Shibata et al. | 313/141 |
| 6,492,289 | B1 * | 12/2002 | Suzuki et al. | 501/14 |
| 6,566,792 | B2 * | 5/2003 | Nishikawa | 313/118 |
| 6,756,722 | B2 * | 6/2004 | Hiramatsu | 313/144 |
| 2005/0110381 | A1 * | 5/2005 | Kanao | 313/141 |
| 2007/0188064 | A1 * | 8/2007 | Lykowski | 313/141 |

* cited by examiner

*Primary Examiner*—Nimeshkumar D. Patel
*Assistant Examiner*—Thomas A Hollweg
(74) *Attorney, Agent, or Firm*—Sughrue Mion, PLLC

(57) ABSTRACT

A spark plug in which a glaze is applied to a rear trunk portion (245), a shoulder portion (240), and a portion of a intermediate diameter portion (230) of an insulator (200), and glaze firing is performed. Even when the glaze (shown by dots in the drawings) softened by heating flows downwards, the glaze is accommodated within a groove portion (235) formed between the shoulder portion (240) and the maximum diameter portion (210), and does not reach the maximum diameter portion (210). Such structure facilitates assembly of the insulator (200) to a metallic shell in a spark plug manufacturing process.

9 Claims, 12 Drawing Sheets

SPARK PLUG

BACKGROUND OF THE INVENTION

1. Field of the Invention

The present invention relates to a spark plug having a metallic shell that is crimped so as to integrally fix an insulator thereto.

2. Description of the Related Art

Conventionally, a spark plug is used for ignition of an internal combustion engine. A spark plug typically includes a metallic shell holding an insulator into which a center electrode is inserted, and a ground electrode welded to a front end portion of the metallic shell. The distal end of the ground electrode faces the front end of the center electrode, thereby forming a spark discharge gap therebetween. Spark discharge occurs between the center electrode and the ground electrode. In such a spark plug, in which a step portion formed on an outer circumferential surface of the insulator is supported by a step portion formed on a front-end-side inner circumferential surface of the metallic shell, the insulator is crimped by a crimp portion provided at the rear end of the metallic shell. Thus, the insulator and the metallic shell are fixed together, while close contact between the two steps is maintained. Further, talc and/or a packing may be accommodated within the interior of the crimp portion, so that the insulator and the metallic shell are fixed more reliably, and air-tightness is secured.

In recent years, with increasing demand for enhanced power output of automotive engines and reduced fuel consumption, there is a demand for a reduction in size and diameter of a spark plug from the viewpoint of securing freedom in engine design. One conceivable solution for reducing the size and diameter is to reduce the respective sizes of the spark plug components. For example, the size and diameter of the insulator can be reduced. However, if the diameter of the entire insulator, which is formed of a fired ceramic, is reduced, the risk of breaking the insulator increases due to a reduction in strength. Therefore, reducing the diameter of the insulator is not a preferred approach. In view of the above, attempts have been made to reduce the overall size and diameter of a spark plug by reducing the diameter of the metallic shell which is of higher strength.

Reducing the diameter of a spark plug in this way requires a reduction in the wall thickness of the metallic shell or a reduction in the clearance between the insulator and the metallic shell. As an example structure for reducing the clearance, the diameter of an intermediate trunk portion of the insulator which is used to hold the insulator within the metallic shell may be reduced so as to be close to that of a rear trunk portion formed on a rear end side of the intermediate trunk portion. Since this intermediate trunk portion includes a portion which has the largest outer diameter (a maximum diameter portion), if the diameter of the metallic shell is reduced to match the reduced outer diameter of the intermediate trunk portion, the diameter of the entire spark plug can be reduced. However, since the crimp portion comes closer to the rear trunk portion, it becomes difficult to pack talc or the like into the interior of the crimp portion (the clearance between the crimp portion and the rear trunk portion) as in the case of the above-described conventional structure. In such a case, hot crimping is preferably performed so as to maintain air-tightness after crimping (see, for example, Patent Document 1). Specifically, a thin wall portion provided on a trunk portion of the metallic shell is heated so as to reduce resistance to deformation, and the crimp portion is crimped in this state. As a result, crimping by means of plastic deformation of the crimp portion and crimping by making use of a difference in thermal expansion between the insulator and the metallic shell are realized simultaneously. In this manner, a shoulder portion of the intermediate trunk portion of the insulator is pressed toward the front end by means of the crimp portion. Thus, air-tightness can be secured between the step portion of the metallic shell and the step portion of the insulator without packing talc or the like.

Incidentally, for the purpose of, for example, preventing flashover, a glaze layer is formed on a portion (rear trunk portion) of the insulator, which portion is exposed from the rear end portion of the metallic shell. As has been empirically known, the breakage resistance of the insulator can be improved when the glaze layer is formed to extend from the rear end of the insulator, covering the entire rear trunk portion, and further covering the shoulder portion of the intermediate trunk portion. Therefore, it is desirable to reliably form the glaze layer in the above-described portion of the insulator of the spark plug.

In general, the glaze layer is formed as follows. A glaze slurry to be applied to an insulator is prepared by crushing a glass component which constitutes the glaze layer and mixing it into a solvent medium. By use of a roller, a sprayer, or the like, this glaze slurry is applied to a predetermined portion of a horizontally supported insulator; that is, a region extending from the rear end of the insulator to the shoulder portion of the intermediate trunk portion thereof. Subsequently, the insulator is dried in order to improve workability. Subsequently, the insulator applied with the glaze slurry is placed in a heating furnace, and is fired at a predetermined temperature, whereby a glaze layer is formed (hereinafter, this step is also referred to as "glaze firing").

In the above-described glaze firing, when firing is performed with the insulator held horizontally, in some cases, the heated and softened glaze flows downward and forms a biased layer. If a formed glazed layer has a non-circular cross section, flashover disadvantageously becomes difficult to prevent, and appearance is impaired. A conceivable measure for avoiding this problem is to fire the insulator while rotating the same. Alternatively, firing can be performed with an insulator held vertically, which is more efficient since rotating the insulator becomes unnecessary. Moreover, in view of the above-described problems, firing is desirably performed with the rear end of an insulator directed upward.

[Patent Document 1] Japanese Patent Application Laid-Open (kokai) No. 2003-257583

Problems to be Solved by the Invention

However, if the glaze having become soft as a result of heating flows downward from the shoulder portion of an insulator, in some cases, the glaze covers a portion (a maximum diameter portion) which is formed on the front end side with respect to the shoulder portion, and a glaze layer is formed on the maximum diameter portion. Particularly, a spark plug which must have a reduced size and diameter is designed to have a reduced clearance between the maximum diameter portion of the insulator and the inner circumferential surface of the metallic shell. Therefore, there is a possibility that the insulator having a glaze layer formed thereon cannot be inserted into the metallic shell, and thus, assembly cannot be completed. Further, even when assembly can be performed, the insulator may become eccentric relative to the metallic shell. In order to avoid this problem, the application amount of the glaze must be strictly controlled, and the number of steps may increase because of checking work or the like. Further, the production yield is likely to decrease. Therefore, reduction of the size and diameter of spark plugs cannot be realized at low cost.

SUMMARY OF THE INVENTION

The present invention has been achieved to solve the above problems, and an object thereof is to provide a spark plug having a structure such that even when glaze flows downward at the time of glaze firing of an insulator, the glaze does not cover a portion having a large outer diameter, to thereby prevent eccentricity of the insulator, which eccentricity may otherwise result when the insulator is assembled to a metallic shell, and which spark plug has a reduced size and diameter.

The above-object of the present invention has been achieved by providing (1) a spark plug which comprises: a center electrode; a ground electrode forming a spark gap between the center electrode and the ground electrode; an insulator having an intermediate trunk portion, a rear trunk portion provided rearwards of the intermediate trunk portion, and an axial hole extending along an axis of the insulator, the insulator holding the center electrode within the axial hole at a front end thereof; and a metallic shell accommodating the intermediate trunk portion of the insulator and having a crimp portion at the rear end thereof. The intermediate trunk portion of the insulator further includes: a shoulder portion pressed forward by means of the crimp portion; a maximum diameter portion disposed frontward of the shoulder portion and having a maximum outer diameter among those portions constituting the intermediate trunk portion; and a intermediate diameter portion connecting the shoulder portion and the maximum diameter portion, having a smaller diameter than the maximum diameter portion, and having a groove portion extending at least in a circumferential direction on the outer surface of the intermediate diameter portion. The spark plug further includes a glaze layer which is formed on a surface of the insulator extending from the rear trunk portion located rearward of the intermediate trunk portion to a point between the shoulder portion of the intermediate trunk portion and the groove portion.

In a preferred embodiment (2), the spark plug (1) above is characterized in that the surface of the insulator is exposed so as not to be covered by the glaze layer at the maximum diameter portion.

In another preferred embodiment (3), the spark plug (1) or (2) above is characterized in that the difference in radius between the maximum diameter portion and the intermediate diameter portion is equal to or greater than 0.05 mm but not greater than 0.15 mm.

EFFECTS OF THE INVENTION

A spark plug which can improve the breakage resistance of the insulator and prevent eccentricity of the insulator at the time of assembly can be realized by forming a groove portion on the insulator and forming a glaze layer up to a point between the groove portion and the shoulder portion according to (1) above. By providing a groove portion, it becomes possible to avoid certain production steps otherwise needed for excessively accurate control of application amount and for checking the portion where the glaze layer is formed, to thereby improve production yield. This is because the softened glaze that flows downwards at the time of glaze firing can be accommodated within the groove, whereby application of the glaze to the maximum diameter portion can be avoided without fail. The groove portion preferably has a width (D) of at least 0.3 mm but not greater than 1.0 mm, and also preferably has a depth (C) of at least 50 μm but not greater than 200 μm as measured from surface of the intermediate diameter portion.

In the case where the surface of the insulator is exposed at the maximum diameter portion located forward of the groove portion of the insulator as in embodiment (2) above, i.e., when the glaze layer is not formed on the surface of the maximum diameter portion with the groove portion serving as a boundary, problems in assembly and in the insulator becoming eccentric at the time of assembly can be eliminated.

A spark plug having the above-described structure is preferably fabricated such that the difference in radius between the maximum diameter portion and the intermediate diameter portion is equal to or greater than 0.05 mm but not greater than 0.15 mm as described in (3) above. The intermediate diameter portion accommodates excess glazing material. To accommodate excess glaze material, the intermediate diameter portion preferably has an axial length equal to or greater than 2.0 mm (but not greater than 5.0 mm). When the radius difference is less than 0.05 mm, however, the intermediate diameter portion cannot efficiently accommodate excess glazing material. This is because the outermost portion in the radial direction of the glaze layer formed on the intermediate diameter portion excluding the groove portion may be located on the outer side of the maximum diameter portion. In such a case, when the insulator having the glaze layer formed thereon is assembled to the metallic shell, the axis of the metallic shell and that of the insulator may deviate from each other, or assembly may become difficult. Meanwhile, when the difference in radius exceeds 0.15 mm, the area of engagement between the crimp portion of the metallic shell and the shoulder portion of the insulator decreases, and it becomes difficult to sufficiently maintain air-tightness of the combustion chamber. By setting the difference in radius to a value equal to or greater than 0.05 mm but not greater than 0.15 mm, it becomes possible to form on the insulator a glaze layer having a proper thickness, and to avoid failure during assembly of the metallic shell and the insulator. Notably, the radius difference can be controlled on the basis of dimensions before forming the glaze layer.

DESCRIPTION OF REFERENCE NUMERALS

Figure 1:
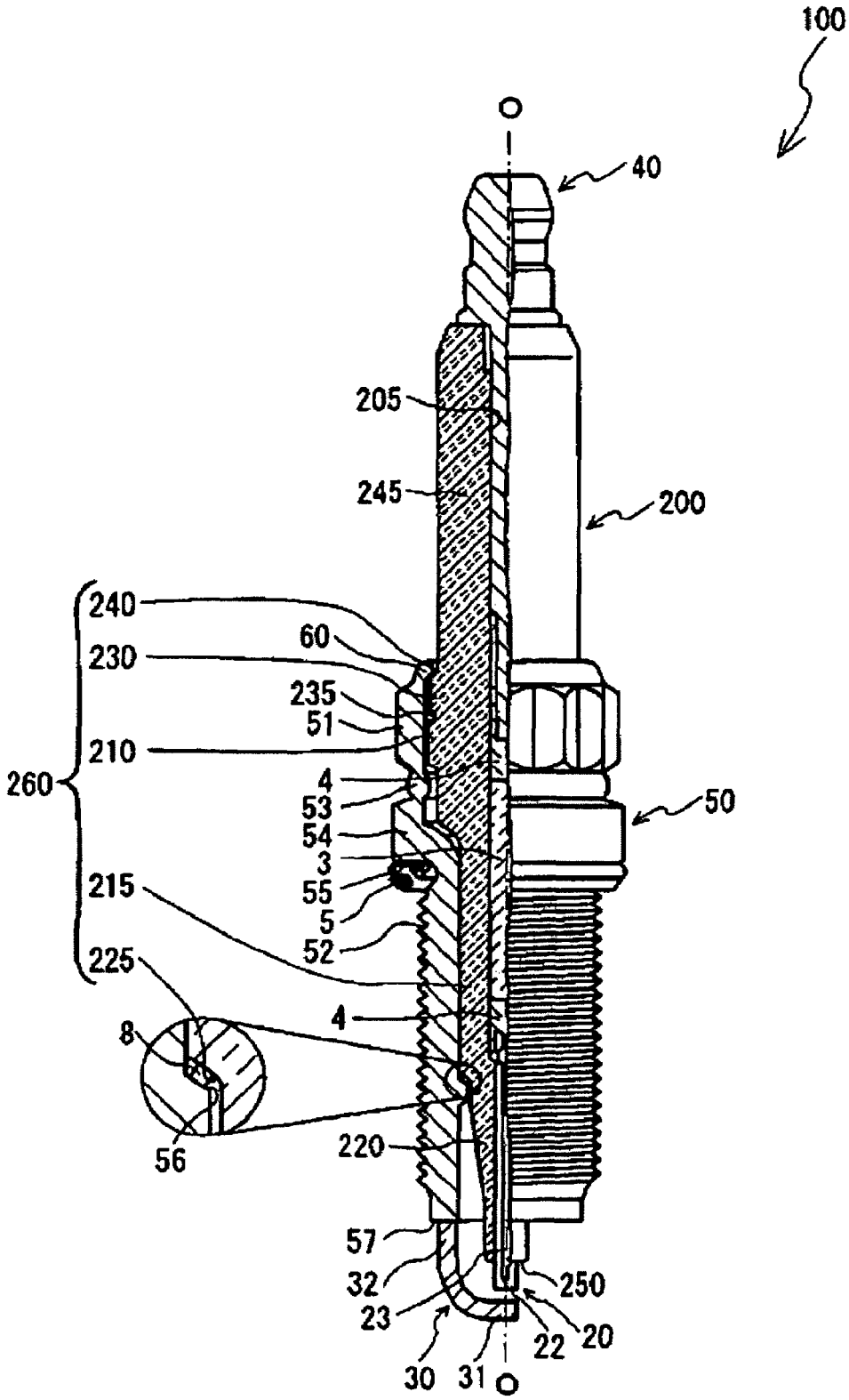
FIG. 1 is a partial sectional view of a spark plug 100.

Reference numerals used to identify various structural features in the drawings include the following:

20: center electrode, 50: metallic shell, 60: crimp portion, 100: spark plug, 200: insulator, 205: axial hole, 210: maximum diameter portion, 230: intermediate diameter portion, 235: groove portion, 240: shoulder portion, 245: rear trunk portion, 260: intermediate trunk portion, 280: glaze layer

DETAILED DESCRIPTION OF THE INVENTION

Figure 2:
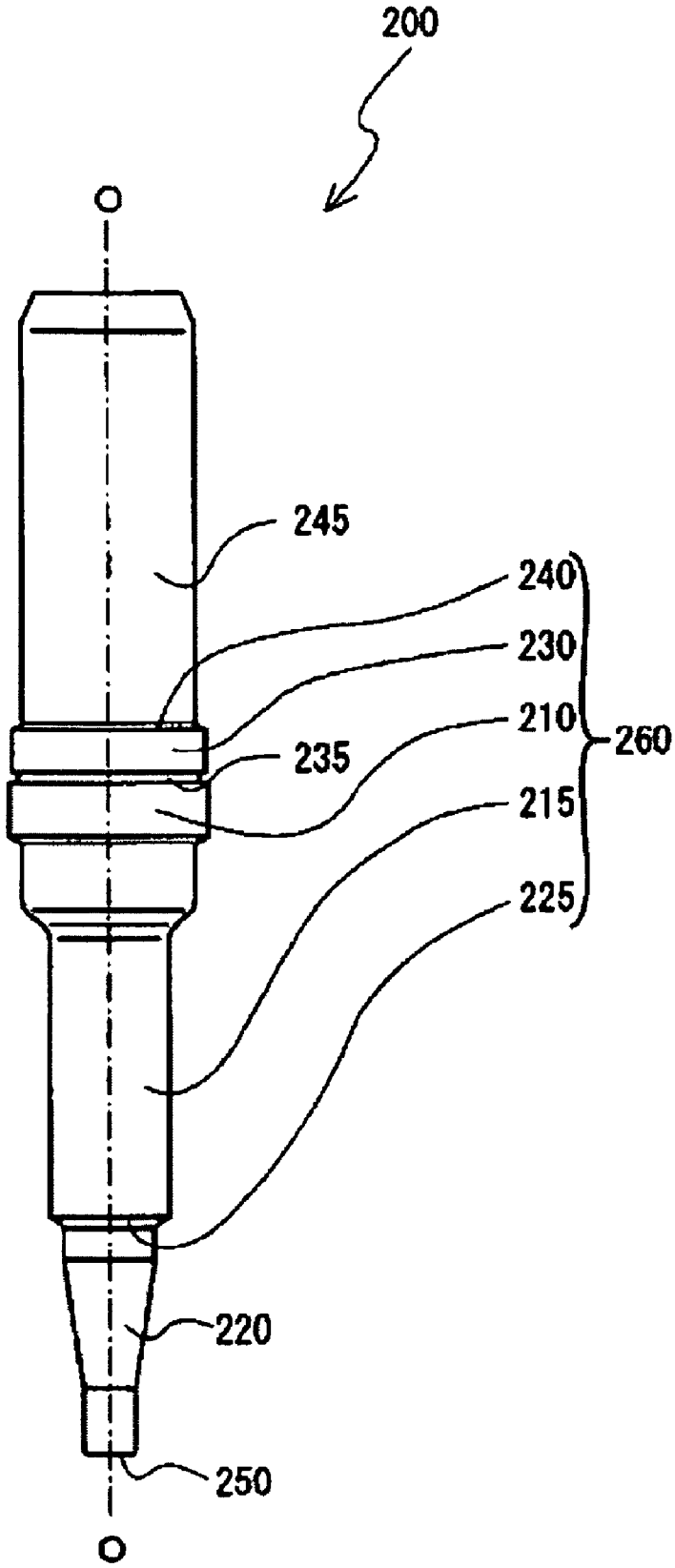
FIG. 2 is a side view of an insulator 200.
Figure 3:
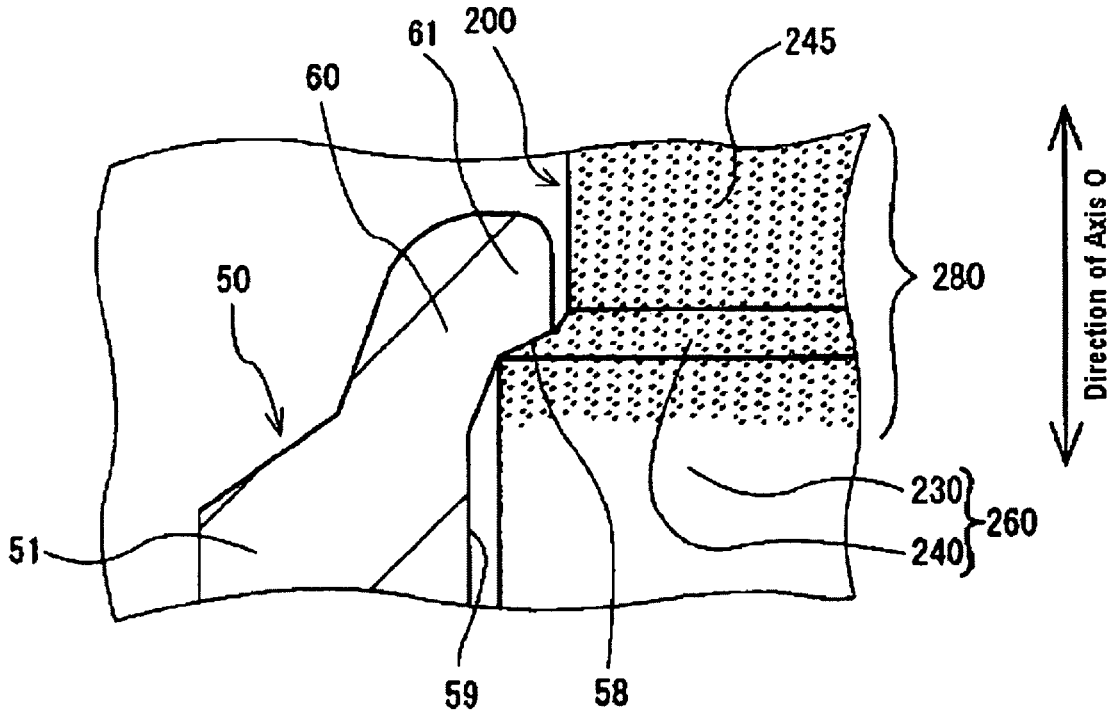
FIG. 3 is a partial sectional view showing, in an enlarged scale, a crimp portion 60 and its vicinity.

A spark plug according to an embodiment of the present invention will next be described with reference to the drawings. However, the present invention should not be construed as being limited thereto. First, by reference to FIG. 1 to 3, the structure of a spark plug 100 of the present embodiment will be described. FIG. 1 is a partial sectional view of the spark plug 100. FIG. 2 is a side view of an insulator 200. FIG. 3 is a partial sectional view showing a crimp portion 60 and its vicinity in an enlarged scale. In the following description, the direction of an axis O of the spark plug 100 in FIG. 1 will be referred to as the vertical direction in the drawings, while the lower side will be referred to as a front-end side of the spark plug 100, and the upper side will be referred to as a rear-end side of the spark plug 100.

As shown in FIG. 1, the spark plug 100 is mainly composed of the insulator 200; a metallic shell 50 which holds the insulator 200; a center electrode 20 held within the insulator 200 and extending along the direction of the axis O; a ground electrode 30 having a proximal end portion 32 welded to a front end surface 57 of the metallic shell 50 and a distal end portion 31 whose one side surface faces a front end portion 22 of the center electrode 20; and a metallic terminal member 40 provided at a rear end portion of the insulator 200.

First, the insulator 200 of the spark plug 100 will be described. As is well known, the insulator 200 is formed through firing of alumina or the like, and assumes the form of a tube which has at its center an axial hole 205 extending along the direction of the axis O, as shown in FIG. 1. As shown in FIG. 2, a maximum diameter portion 210 having a maximum outer diameter among those portions constituting the intermediate trunk portion is formed at an approximate center of the insulator 200 with respect to the axis O direction; and a front-end-side trunk portion 215 which has a smaller diameter so as to match the shape of the inner circumference of the metallic shell 50 is formed frontward (lower side in FIG. 2) of the maximum diameter portion 210. Further, a leg portion 220 which has an outside diameter smaller than that of the front-end-side trunk portion 215 and which is exposed to a combustion chamber when the spark plug is mounted in an internal combustion engine, is formed frontward of the front-end-side trunk portion 215. A step portion 225 is provided between the leg portion 220 and the front-end-side trunk portion 215.

A intermediate diameter portion 230 having an outside diameter smaller than that of the maximum diameter portion 210 by greater or equal to 0.1 mm but not greater than 0.3 mm, is formed rearward (upper side in FIG. 2) of the maximum diameter portion 210. The intermediate diameter portion 230 has a narrow groove portion 235 in the vicinity of the boundary between the maximum diameter portion 210 and the intermediate diameter portion 230. The groove portion 235 has an outside diameter smaller than that of the intermediate diameter portion 230 and extends along the entire circumference of the insulator. The groove portion has a width of 0.6 mm, while the total axial length of intermediate diameter portion 230 (including the groove portion) is 2.7 mm. A rear trunk portion 245 having an outer diameter smaller than that of the intermediate diameter portion 230 but greater than that of the front-end-side trunk portion 215 is formed rearward of the intermediate diameter portion 230, and is exposed to the outside when the insulator 200 is assembled to the metallic shell 50. This rear trunk portion 245 has a long length so as to secure a large insulation distance between the metallic shell 50 and the metallic terminal member 40. Moreover, a shoulder portion 240 having a gently curved taper slant surface is formed between the rear trunk portion 245 and the intermediate diameter portion 230. The shoulder portion 240, the intermediate diameter portion 230 including the groove portion 235 formed on the surface thereof, the maximum diameter portion 210, the front-end-side trunk portion 215, and the stepped portion 225 constitute an intermediate trunk portion 260, which is a portion used to hold the insulator 200 within the metallic shell 50, which will be described below.

Next, as shown in FIG. 1, the center electrode 20 is formed of, for example, a nickel-based alloy such as INCONEL™ 600 or 601, and includes therein a metal core 23 formed of, for example, copper, having excellent heat conductivity. The front end portion 22 of the center electrode 20 projects from a front end surface 250 of the insulator 200 and is formed to have a reduced diameter toward its front end. The center electrode 20 is electrically connected to the metallic terminal member 40 located thereabove via a seal member 4 and a ceramic resistor 3 provided in the axial hole 205. A high-voltage cable (not shown) is connected to the metallic terminal member 40 via a plug cap (not shown) so as to apply a high voltage.

Next, the ground electrode 30 will be described. The ground electrode 30 is formed of a metal having high corrosion resistance. For example, a nickel-based alloy such as INCONEL™ 600 or 601 is used. The ground electrode 30 itself has a generally rectangular transverse cross section, and the proximal end portion 32 thereof is joined to the front end surface 57 of the metallic shell 50 by means of welding. Further, the distal end portion 31 of the ground electrode 30 is bent such that one side surface thereof faces the front end portion 22 of the center electrode 20.

Next, the metallic shell 50 will be described. The metallic shell 50 is a cylindrical tubular metal member for fixing the spark plug 100 to the engine head of an unillustrated internal combustion engine. The metallic shell 50 holds the insulator 200 in such a manner as to surround the intermediate trunk portion 260. The metallic shell 50 is formed of an iron-based material, and includes a tool engagement portion 51 to which an unillustrated spark plug wrench is fitted, and an external-thread portion 52 which is engaged with the engine head provided at an upper portion of the unillustrated internal combustion engine. In the spark plug 100 of the present embodiment, the tool engagement portion 51 is configured in accordance with Bi-HEX specifications so as to reduce its diameter. However, the shape of the tool engagement portion is not limited thereto, and may assume a conventionally employed hexagonal shape.

A thin wall portion 53 and a flange portion 54 are formed between the tool engagement portion 51 and the external-thread portion 52 of the metallic shell 50. The thin wall portion 53 has a wall thickness smaller than that of the remaining portion of the metallic shell 50. Further, a gasket 5 is fitted to the vicinity of the rear end the external-thread portion 52; i.e., on a seat surface 55 of the flange portion 54. Notably, in FIG. 1, the thin wall portion 53 is depicted as having an increased wall thickness. This is because FIG. 1 shows a state after the thin wall portion 53 has been deformed by means of hot crimping, which will be described below.

As shown in FIG. 3, the crimp portion 60 is provided rearward of the tool engagement portion 51. The crimp portion 60 assumes a cylindrical shape, and is formed by extending the radially-inner-side circumferential edge portion of the tool engagement portion 51 rearward along the direction of the axis O. The inner circumferential surface 58 of the crimp portion 60 is continuous with the inner circumferential surface 59 of the tool engagement portion 51.

Incidentally, as shown in FIG. 1, the insulator 200 is inserted into the metallic shell 50 from the rear-end side thereof, and its step portion 225 is supported via a plate packing 8 by means of a step portion 56 formed within the metallic shell 50 at the front end side thereof. In this state, as shown in FIG. 3, a distal end portion 61 of the crimp portion 60 is bent inward so as to perform crimping. As a result, the inner circumferential surface 58 of the crimp portion 60 comes into contact with the shoulder portion 240 of the insulator 200. As a result, the intermediate trunk portion 260 is held within the metallic shell 50 with the shoulder portion 240 pressed downward along the direction of the axis O, whereby the metallic shell 50 and the insulator 200 are integrated as shown in FIG. 1. Moreover, the thin wall portion 53 is heated to, for example, about 700° C. so as to lower resistance to deformation to thereby perform so-called hot crimping, which enhances air-tightness by means of a difference in thermal expansion between the metallic shell 50 and the insulator 200. Notably, the crimp portion 60 corresponds to the "crimp portion" of the present invention.

In the spark plug 100 configured in the above-described manner, as shown in FIG. 3, the crimping creates a state in which the inner circumferential surface 58 of the crimp portion 60 of the metallic shell 50 is in contact with the shoulder portion 240 of the insulator 200. A glaze layer 280 (shown by dots in FIG. 3) for preventing flashover is formed on the surface of the rear trunk portion 245 of the insulator 200 projecting outward from the metallic shell 50. In this embodiment, this glaze layer 280 is also formed on the surface of the shoulder portion 240 and the surface of a portion of the intermediate diameter portion 230. This configuration improves the breakage resistance of the insulator 200.

Figure 4A:
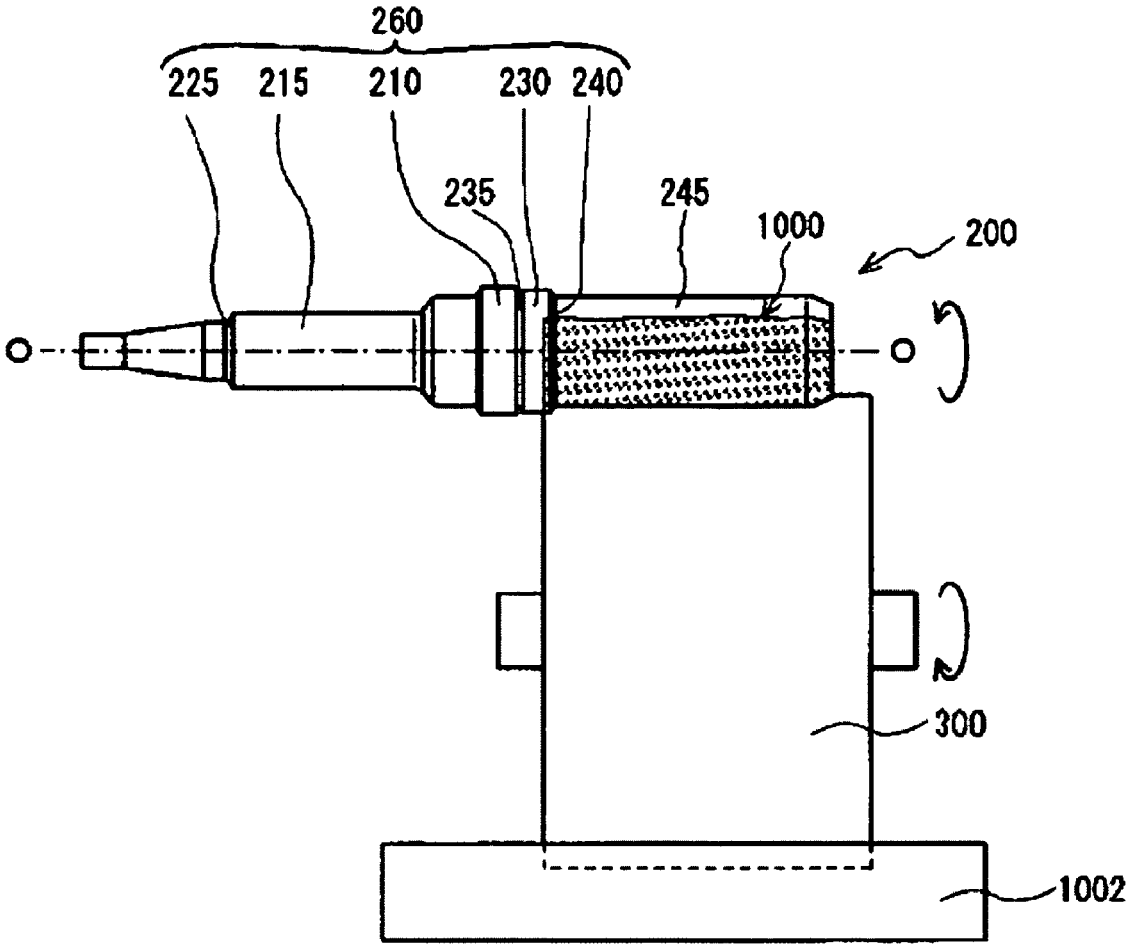
FIGS. 4A and 4B are views schematically showing a step of applying a glaze on the surface of the insulator 200.
Figure 4B:
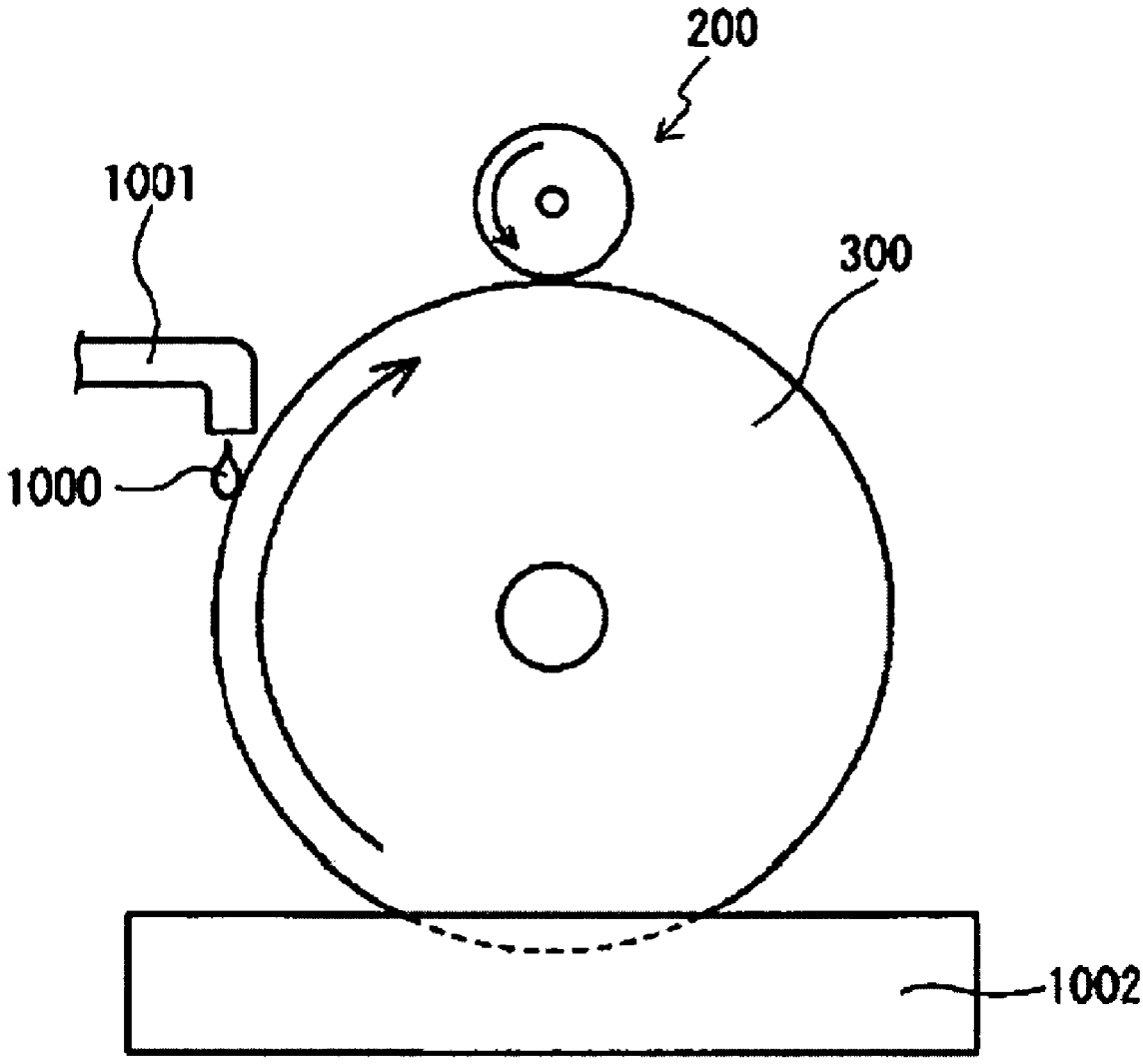

In the present embodiment, in order to reliably form the glaze layer 280 on the shoulder portion 240, the glaze layer 280 is formed in accordance with a manufacturing process as described below. FIG. 4 schematically shows the manufacturing process. As shown in a side view of FIG. 4A, an insulator 200 is journaled in such manner that the intermediate diameter portion 230, the shoulder portion 240, and the rear trunk portion 245 of the insulator 200 come into contact with a glaze application roller 300 well known to those of ordinary skill in this field of art. Meanwhile, for forming the glaze layer 280, a glaze slurry 1000 is prepared by mixing a glass component or the like (raw material) into a solvent medium. As shown in a front view of FIG. 4B showing the glaze application process, the glaze slurry 1000 fed via a pipe 1001 is applied to the roller 300. The glaze slurry 1000 is applied to the insulator 200 in contact with the roller 300 in such manner that the glaze slurry 1000 covers the surfaces of the intermediate diameter portion 230, the shoulder portion 240, and the rear trunk portion 245. A catch pan 1002 for the glaze slurry 1000 is disposed under the roller. In this manner, the glaze is applied to a predetermined portion of the insulator 200 in the form of the glaze slurry 1000. Subsequently, the insulator 200 carrying the glaze slurry 1000 applied thereto is separated from the roller 300 while being journaled, and is dried by means of an unillustrated burner. This drying step is performed because problems such as dripping of the glaze may occur if the glaze slurry 1000 is not dried after being applied.

Figure 5:
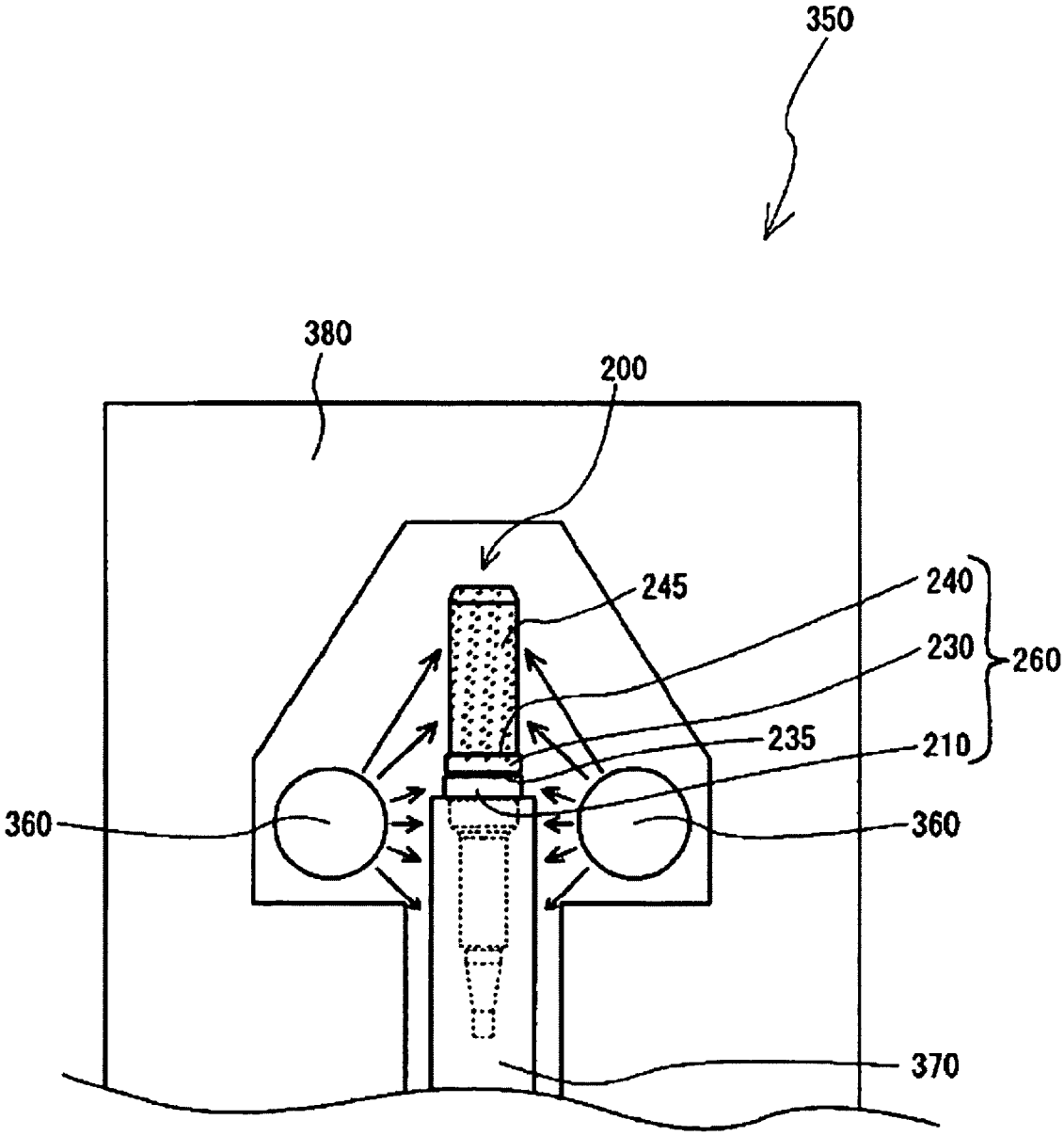
FIG. 5 is a view schematically showing a step of firing the insulator 200 carrying the glaze applied thereto.

Subsequently, the insulator 200 is placed in an electric furnace 350 as shown in FIG. 5, to carry out glaze firing. The electric furnace includes a kiln 380 formed of refractory bricks, ceramic fiber board, or the like. A pair of bar-shaped ceramic heaters 360 are disposed within the kiln 380 so as to heat the insulator 200 from the left and right sides thereof. The insulator 200 is placed on a support member 370 which is provided on an unillustrated belt conveyor and passes through the kiln 380.

The insulator 200 is placed on the support member 370 with its rear end directed upward, so that the rear trunk portion 245, the shoulder portion 240, and the intermediate diameter portion 230, to which the glaze has been applied, are exposed. By means of heating by the ceramic heaters 360, the glaze applied on the surface of the insulator 200 is fired at a high temperature of, for example, 800° C. or higher.

Figure 6:
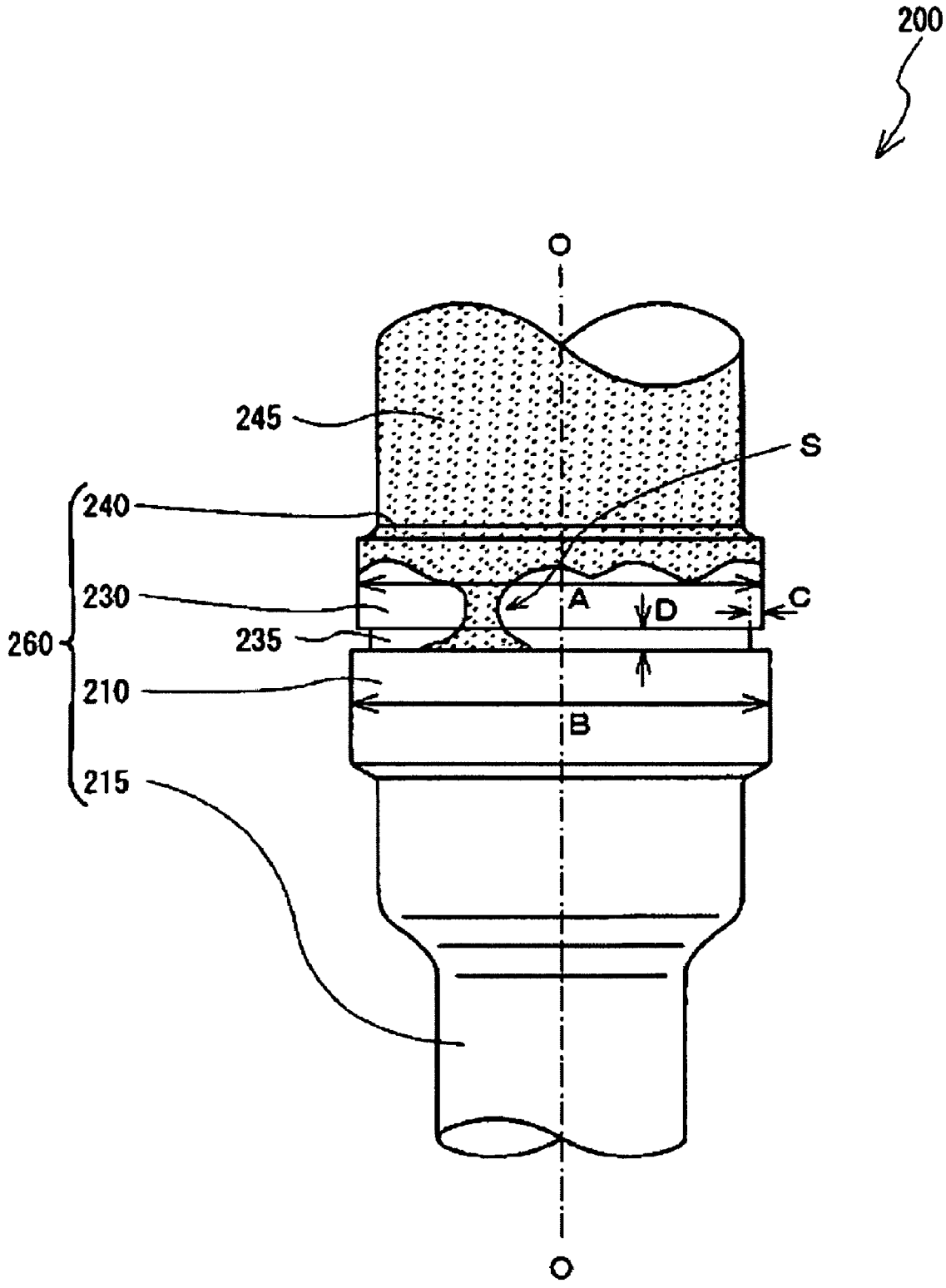
FIG. 6 is side view of the insulator 200 showing a state in which a portion of the glaze flowing down at the time of glaze firing is accommodated within a groove portion 235.

At this time, as shown in FIG. 6, when the glaze applied on the surface of the insulator 200 becomes soft due to heating, in some cases, as indicated by S, the glaze flows down toward the maximum diameter portion 210 located below the intermediate diameter portion 230. However, when a portion of the flowing glaze reaches the groove portion 235 formed between the intermediate diameter portion 230 and the maximum diameter portion 210, the subject glaze portion flows along the groove portion 235 due to surface tension and adhesive force of the glaze against the surface of the groove portion 235. Consequently, excess glaze flowing downwards is accommodated by the groove portion 235, and does not reach the maximum diameter portion 210. When the insulator 200 is fired and the glaze has settled in this state, a glaze layer 280 is not formed on the surface of the maximum diameter portion 210. Thus, when the insulator 200 is assembled to the metallic shell 50, there is nothing present between the outer circumferential surface of the maximum diameter portion 210 and the inner circumferential surface of the metallic shell 50. As a result, the insulator 200 can be smoothly inserted into the metallic shell 50, and the insulator 200 can maintain a concentric condition during assembly.

In order to enable smooth assembly of the insulator 200 into the metallic shell 50 even when the glaze layer 280 is formed on a portion of the intermediate diameter portion 230 of the insulator 200, the outer diameter A of the intermediate diameter portion 230 is desirably made smaller than the outer diameter B of the maximum diameter portion 210, as shown in FIG. 6. Specifically, assembly of the insulator 200 can be performed smoothly when the outer diameter B of the maximum diameter portion 210 is greater than the outer diameter A of the intermediate diameter portion 230 by at least an amount corresponding to a radius difference of 0.05 mm. This is shown in the results of an evaluation test of Example 1 described below. Meanwhile, in the case where the outer diameter A of the intermediate diameter portion 230 is decreased in order to further increase the radius difference, in order to sufficiently maintain air-tightness by means of crimping, the difference between the outer diameter B of the maximum diameter portion 210 and the outer diameter A of the intermediate diameter portion 230 is preferably made equal to or less than an amount corresponding to a radius difference of 0.15 mm, in consideration of the results of the evaluation test of Example 1.

In the case of a spark plug which is manufactured such that the external-thread portion for attachment to the engine head has a screw diameter of M12 or less, the groove portion 235 is preferably formed to have a width (D) of at least 0.3 mm but not greater than 1.0 mm and a depth (C) of at least 50 μm but not greater than 200 μm with respect to the surface of the intermediate diameter portion 230. When the width D of the groove portion 235 is less than 0.3 mm or the depth C thereof is less than 50 μm, a portion of the glaze flowing down during glaze firing cannot be accommodated within the groove portion 235 and may reach the maximum diameter portion 210. Further, when the shoulder portion 240 receives a pressing force toward the front end as a result of crimping, an internal stress stemming from the pressing force is generated within the intermediate diameter portion 230. Therefore, when the width D of the groove portion 235 is greater than 1.0 mm or the depth C thereof is greater than 200 μm, the intermediate diameter portion 230 may fail to provide sufficient rigidity. Notably, even when the groove 235 of the present invention is provided, the application amount of the glaze must be controlled. However, it becomes unnecessary to perform the control with a very high degree of accuracy, unlike the case of conventional spark plugs.

As described above, when a glaze is applied to cover the rear trunk portion 245, the shoulder portion 240, and a portion of the intermediate diameter portion 230, and then glaze firing is performed, the glaze layer 280 can be formed on the shoulder portion 240 of the insulator 200 without fail. That portion of the softened glaze which flows down at the time of glaze firing is accommodated within the groove portion 235, so that the glaze does not reach the maximum diameter portion 210. Therefore, the glaze layer is not formed on the surface of the maximum diameter portion 210 after glaze firing. That is, the surface of the insulator 200 is exposed at the maximum diameter portion 210.

Example 1

An evaluation test was performed in order to confirm the effect attained by making the outer diameter B of the maximum diameter portion 210 greater than the outer diameter A of the intermediate diameter portion 230. In this evaluation test, five samples were prepared for each of five types of insulators differing in radius between the outer diameter B of the maximum diameter portion and the outer diameter A of the intermediate diameter portion. The specific method used to prepare the samples is described below.

Insulators were fabricated such that after firing, the outer diameter A of the intermediate diameter portion and the outer diameter B of the maximum diameter portion had target values of 11.6 mm and 11.8 mm, respectively, and the intermediate diameter portion had a dimensional error of ±0.05 mm. Subsequently, the radius difference (B−A)/2 of each insulator was measured; and the insulators were sorted by radius difference into five types or groups; i.e., a 0.03 mm group, a 0.05 mm group, a 0.10 mm group, a 0.15 mm group, and a 0.17 mm group. Five insulators were prepared for each type (an error range of the radius difference of each type used at the time of sorting was ±0.005 mm).

A glaze layer was formed on each of 25 insulators (five insulators for each of the five types). The glaze layer thus formed had a thickness of 20 μm±5 μm (a glaze layer formed by a typical spark-plug manufacturing process has a thickness of 20 μm). Notably, as in the spark plug 100, a center electrode and a metallic terminal member were previously fitted into the axial hole of each of the insulators.

Meanwhile, a metallic shell to be combined with each of the insulators was formed such that the tool engagement portion had an inner diameter of 12.0 mm, and was surface-treated (Zn plating+chromate treatment: notably, Ni plating may be performed in place of Zn plating) as in the case of known spark plugs. This metallic shell and the above-described insulator were assembled so as to fabricate test sample products (identified as Sample Nos. 1 to 5 corresponding to the insulator types or groups of varying difference in radius). In the present evaluation test, the evaluation was performed for test sample products having no ground electrodes.

Those test sample products in which difficulty had been encountered at the time of fabrication were judged as causing an assembly failure. Three test sample products of the five test sample products of Sample No. 1 (in which the insulator had a radius difference of 0.03 mm) each caused an assembly failure. This failure occurred because a small radius difference between the intermediate diameter portion and the maximum diameter portion of the insulator resulted in unevenness of the glaze layer formed on the surface of the intermediate diameter portion, so that the axis inclined at the time of assembly.

Next, the properly fabricated test sample products were subjected to an air-tightness test pursuant to JIS B8031 6.5 (1995), and sample products whose air leak amount are in excess of 1 ml/min were considered to have failed. The two test sample products of Sample No. 1 not having caused an assembly failure did not exhibit an air-tightness failure. Meanwhile, in the case of Sample No. 5 (in which the insulator had a radius difference of 0.17 mm), of the five test sample products, three test sample products exhibited an air-tightness failure. This is because, in the test sample products of Sample No. 5, an increased radius difference between the intermediate diameter portion and the maximum diameter portion reduces the outer diameter of the shoulder portion. That is, in the test sample products of Sample No. 5, the outer diameter of the shoulder portion becomes smaller as compared with the test sample products of Sample Nos. 2, 3, and 4 in which their shoulder portions have normal outer diameters. Therefore, a sufficiently large axial force was not obtained resulting in air leakage. Table 1 shows the fabricated test sample products and associated test results. Under the column "Overall evaluation," the respective samples were assigned a grade of "X" when an assembly failure occurred; a grade of "Δ" when no assembly failure but an air-tightness failure occurred; and a grade of "O" was assigned when neither an assembly failure nor an air-tightness failure occurred.

TABLE 1

| Sample No. | Radius difference (mm) | Assembly failure (pieces) | Air-tightness failure (pieces) | Overall evaluation |
|---|---|---|---|---|
| 1 | 0.03 | 3 | 0 | X |
| 2 | 0.05 | 0 | 0 | ○ |
| 3 | 0.10 | 0 | 0 | ○ |
| 4 | 0.15 | 0 | 0 | ○ |
| 5 | 0.17 | 0 | 3 | Δ |

The above evaluation test confirms that a radius difference between the intermediate diameter portion and the maximum diameter portion of an insulator equal to or greater than 0.05 mm but not greater than 0.15 mm is desirable for minimizing assembly and air-tightness failures.

Figure 7:
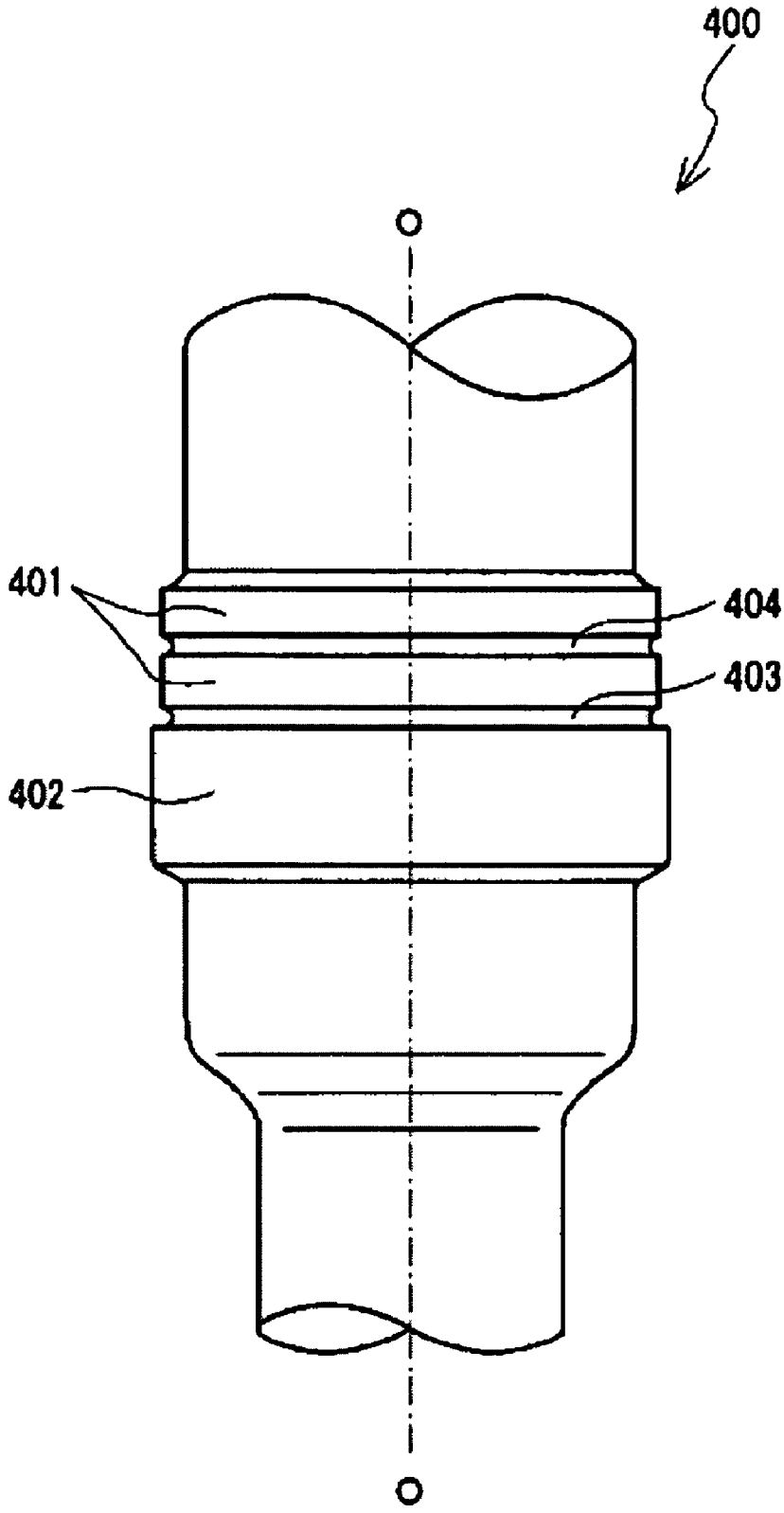
FIG. 7 is an enlarged partial side view of a spark plug 400 according to a modification.

The present invention is not limited to the above-described embodiment, and various modifications are possible. For example, as in an insulator 400 shown in FIG. 7, in addition to a groove portion 403 similar to is desirable above portion in the above-described embodiment, a second groove portion 404 may be formed on a intermediate diameter portion 401.

Moreover, two or more groove portions may be formed on the intermediate diameter portion, which can more reliably stop the flow of glaze at the time of firing, as compared with the above-described embodiment in which a single groove portion is provided. By virtue of this configuration, the glaze does not reach a maximum diameter portion 402, even when tolerances regarding the position and amount of application of the glaze are increased.

Figure 8:
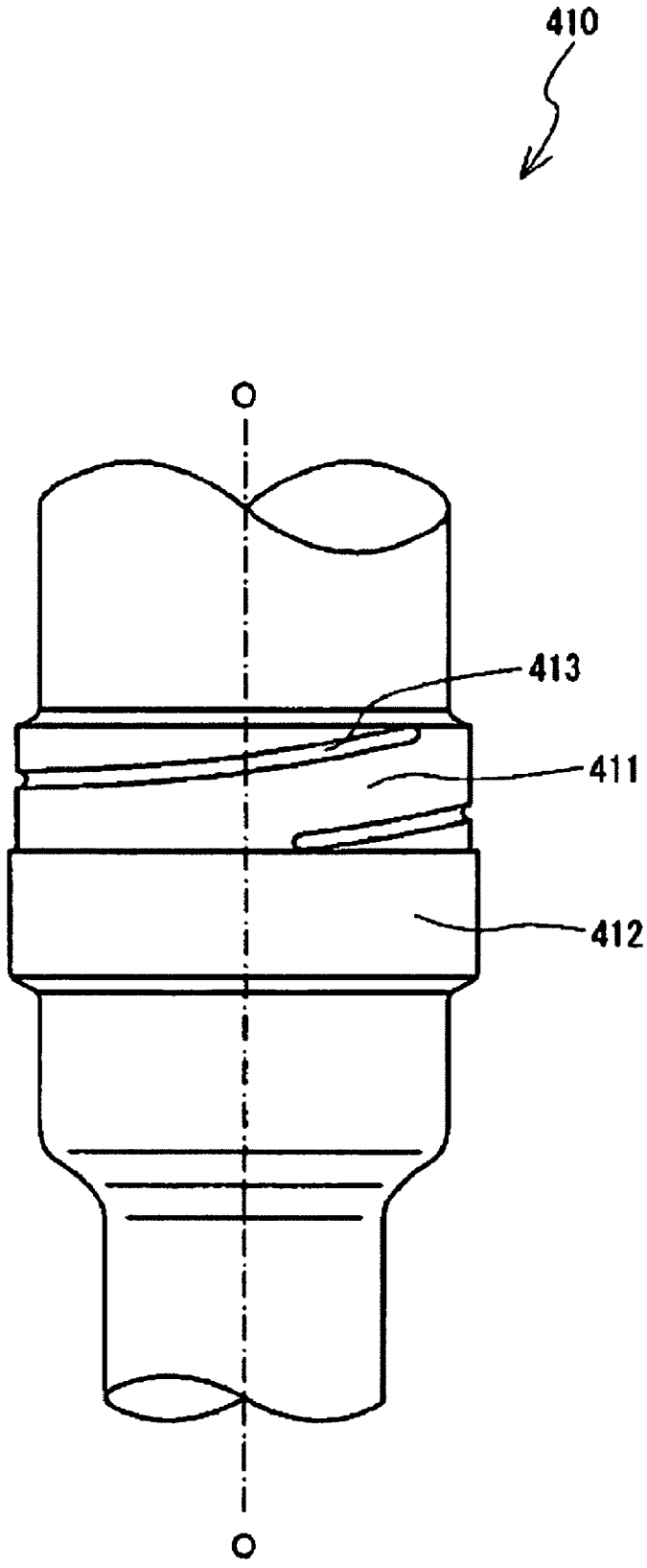
FIG. 8 is an enlarged partial side view of a spark plug 410 according to another modification.

Further, as in insulator 410 shown in FIG. 8, a spiral groove portion 413 may be formed on the outer circumferential surface of a intermediate diameter portion 411. In this case, the glaze is forced to flow along the groove portion 413. Therefore, even when a downward flow of the glaze occurs in a concentrated manner at a certain circumferential position of the insulator 410, the amount of the glaze present at that circumferential position does not increase, and the glaze is prevented from running across the groove portion 413 and reaching a maximum diameter portion 412.

Figure 9:
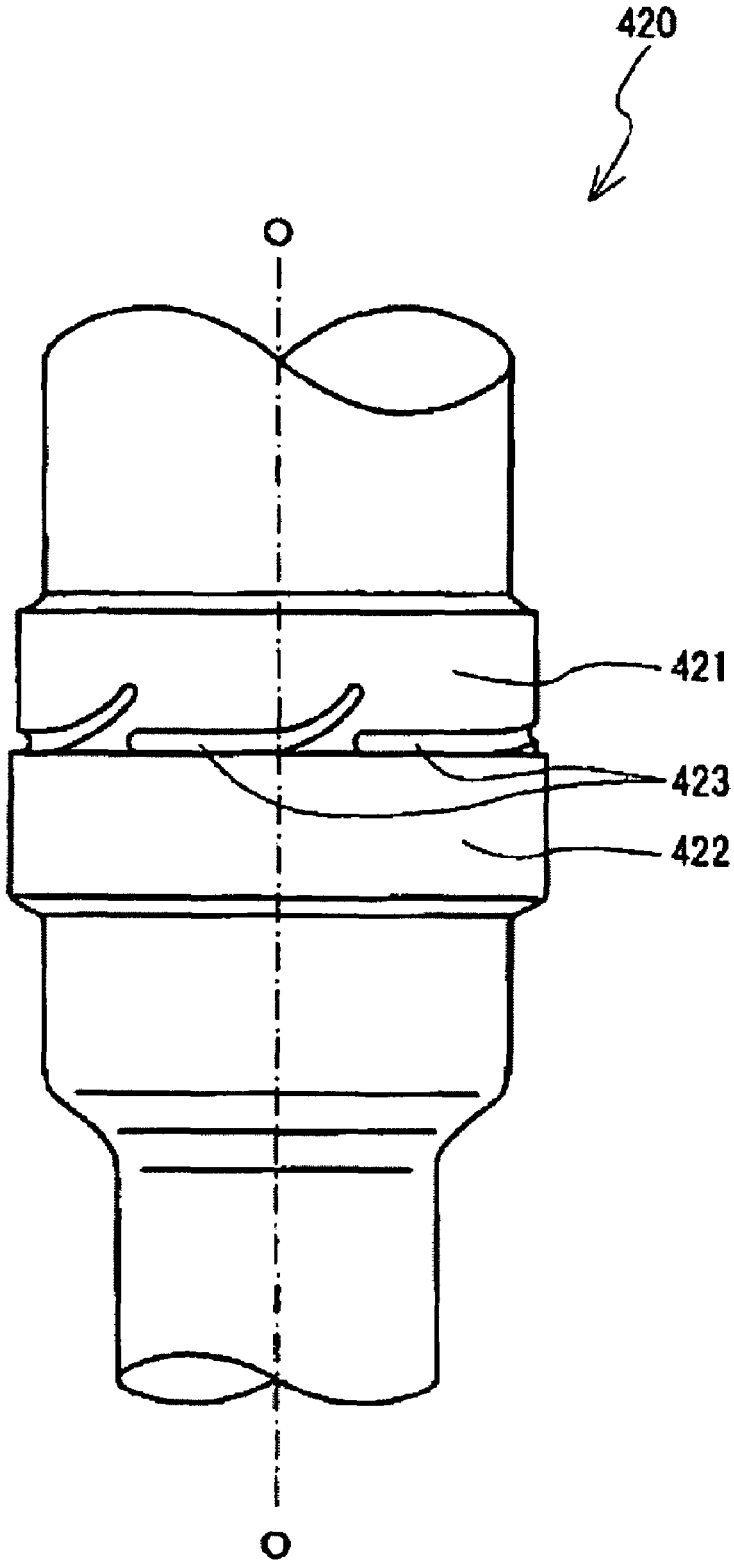
FIG. 9 is an enlarged partial side view of a spark plug 420 according to yet another modification.

Further, as in an insulator 420 shown in FIG. 9, a groove portion 423 may be formed on the outer circumference of a intermediate diameter portion 421 in a non-continuous manner. At the time of glaze firing, the insulator is placed such that the axis O extends vertically. Therefore, the groove portion 423 can sufficiently prevent downward flow of the glaze onto maximum diameter portion 422 if present throughout the entire circumference of the intermediate diameter portion 421 even though its position varies along the direction of the axis O.

Figure 10:
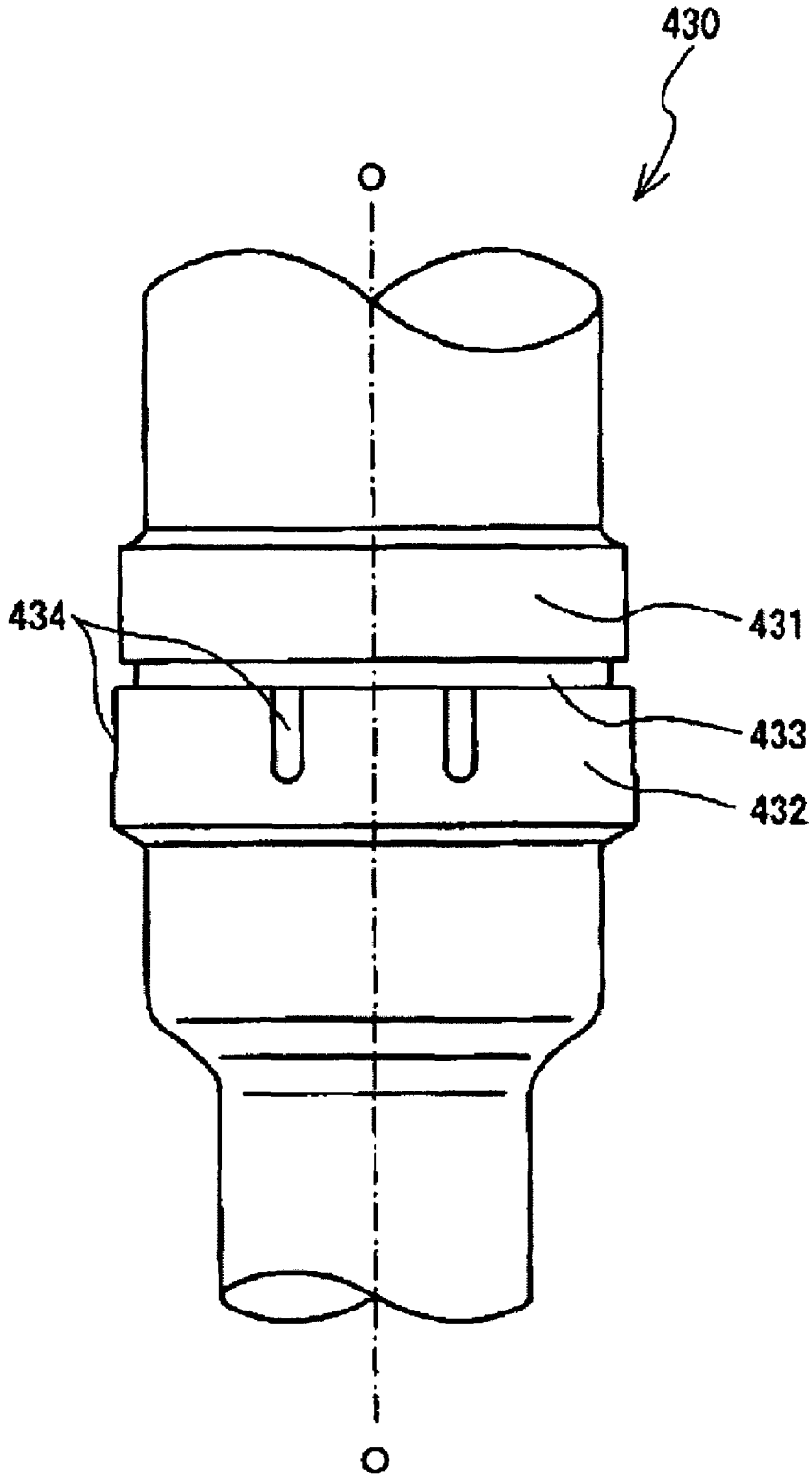
FIG. 10 is an enlarged partial side view of a spark plug 430 according to yet another modification.

Moreover, as in an insulator 430 shown in FIG. 10, a groove portion 433 similar to the groove portion in the above-described embodiment may be formed in a intermediate diameter portion 431, and several recess portions 434 communicating with the groove portion 433 at several circumferential locations may be formed on a maximum diameter portion 432. In this case, even when the amount of glaze running downwards and accommodated within the groove portion 433 at the time of glaze firing is excessive, and a portion of the glaze overflows from the groove portion 433, the overflowing portion of the glaze can be guided into the recess portions 434 so that the glaze does not flow over the surface of the maximum diameter portion 432.

In each of the above-described modifications, the groove portion is formed as a concave portion, and its edge portions connecting to the outer circumferential surface of the intermediate diameter portion assume the form of sharp corners. However, such sharp corners may be chamfered into tapered or curved corners. This configuration prevents so-called accumulation of glaze at the boundaries between the outer circumferential surface of the insulator and the side walls of the groove portion. Needless to say, the corner portions between the side walls and the bottom surface of the groove portion may be rounded so as to eliminate the boundaries between the side walls and the bottom surface or to smoothly connect the side walls and the bottom surface.

Figure 11:
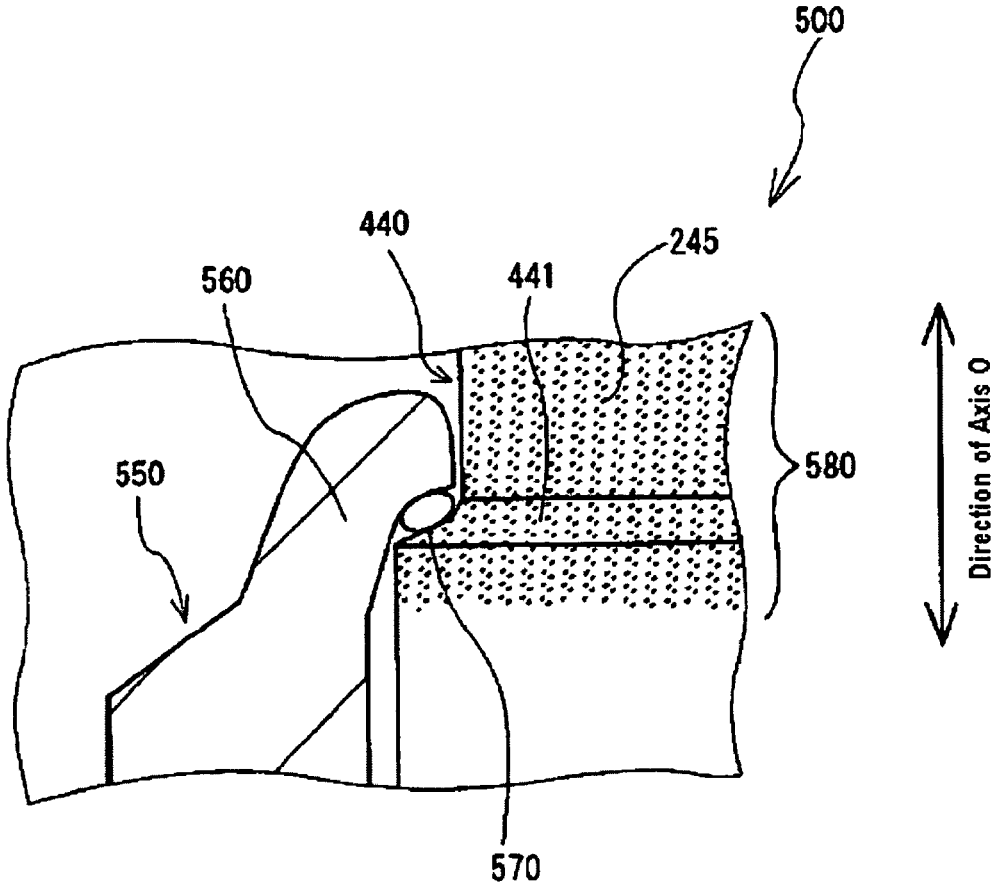
FIG. 11 is a partial sectional enlarged view showing, in an enlarged scale, a crimp portion 560 and its vicinity of a spark plug 500 according to yet another modification.

Moreover, as in a spark plug 500 shown in FIG. 11, an annular metal packing 570 for maintaining air-tightness may be disposed between a crimp portion 560 of a metallic shell 550 and a shoulder portion 441 of an insulator 440. In this case as well, since a glaze layer 580 is reliably formed on the shoulder portion 441, stress acting on the shoulder portion 441, which is pressed by the crimp portion 560 via the packing 570, can be buffered, whereby the strength of the insulator 440 against breakage can be increased.

In the present embodiment, the glaze layer 280 is formed by applying a glaze on the surface of the insulator 200 using a roller 300 and firing the glaze. However, the glaze may be applied by means other than use of a roller. For example, glaze may be applied by use of a sprayer, or by a so-called dipping process in which an insulator is dipped into a glaze stored in a liquid container. Since the groove portion 235 is provided on the insulator 200 such that a problem hardly occurs even when a glaze runs down at the time of glaze firing, even in the case where the glaze is applied by use of a sprayer or a dipping process, the glaze is merely required to be applied to an area extending rearward from a portion of the intermediate diameter portion 230 such that the glaze is applied to the shoulder portion 240 without fail. Therefore, the time and labor required for strictly controlling the position and amount of application of the glaze can be eliminated.

The present invention is effective particularly for spark plugs having a reduced diameter such as one having a screw size of M12 or less, and can be applied to spark plugs whose reduced diameters make charging of talc or the like difficult and in which the difference in outer diameter between the maximum diameter portion and the rear trunk portion of the insulator is less than 1 mm.

This application is based on Japanese Patent Application JP 2005-239176, filed on Aug. 19, 2005, and Japanese Patent Application JP 2006-57545, filed on Mar. 3, 2006, the entire contents of which are hereby incorporated by reference, the same as if set forth at length.

What is claimed is:

1. A spark plug having a front-end side and a rear-end side, comprising:

a center electrode;

a ground electrode forming a spark gap at a front-end side of the spark plug between the center electrode and the ground electrode;

an insulator having an intermediate trunk portion, a rear trunk portion provided rearwards of the intermediate trunk portion, and an axial hole extending along an axis of the insulator, the insulator holding the center electrode within the axial hole at the front end thereof; and a metallic shell accommodating the intermediate trunk portion of the insulator and having a crimp portion at the rear end thereof, wherein the intermediate trunk portion of the insulator includes:

a shoulder portion pressed forward by means of the crimp portion, a maximum diameter portion disposed frontward of the shoulder portion and having a maximum outer diameter among those portions constituting the intermediate trunk portion, and an intermediate diameter portion connecting the shoulder portion and the maximum diameter portion, the entire intermediate portion having a smaller diameter than the maximum diameter portion, and having a groove portion arranged between the shoulder portion and the maximum diameter portion extending at least in a circumferential direction on an outer surface of the intermediate diameter portion, and wherein a glaze layer covers a surface of the insulator extending from a rear trunk portion to a portion located between the shoulder portion and the groove portion.

2. The spark plug as claimed in claim 1, wherein the surface of the insulator is exposed so as not to be covered by the glaze layer at the maximum diameter portion.

3. The spark plug as claimed in claim 1, wherein the difference in radius between the maximum diameter portion and the intermediate diameter portion is equal to or greater than 0.05 mm but not greater than 0.15 mm.

4. The spark plug as claimed in claim 1, wherein the intermediate diameter portion has an axial length equal to or greater than 2.0 mm.

5. The spark plug as claimed in claim 1, wherein the groove has a width of at least 0.3 mm but not greater than 1.0 mm and a depth of at least 50 μm but not greater than 200 μm with respect to the surface of the intermediate diameter portion.

6. The spark plug as claimed in claim 1, wherein the difference in outer diameter between the maximum diameter portion and the rear trunk portion of the insulator is less than 1 mm.

7. The spark plug as claimed in claim 1, wherein excess glaze from the glaze layer is accommodated in the groove portion.

8. A spark plug having a front-end side and a rear-end side, comprising:

a center electrode;

a ground electrode forming a spark gap at a front-end side of the spark plug between the center electrode and the ground electrode;

an insulator having an intermediate trunk portion, a rear trunk portion positioned rearwards of the intermediate trunk portion, said rear trunk portion being covered with a glaze layer, and an axial hole extending along an axis of the insulator, the insulator holding the center electrode within the axial hole at the front end thereof; and a metallic shell accommodating the intermediate trunk portion of the insulator and having a crimp portion at the rear end thereof, wherein the intermediate trunk portion of the insulator includes:

a shoulder portion pressed forward by means of the crimp portion, a maximum diameter portion disposed frontward of the shoulder portion and having a maximum outer diameter among those portions constituting the intermediate trunk portion, and an intermediate diameter portion connecting the shoulder portion and the maximum diameter portion, having a smaller diameter than the maximum diameter portion by equal to or greater than 0.1 mm but not greater than 0.3 mm, and having an axial length of equal to or greater than 2.0 mm, said intermediate diameter portion being at least partially covered by the glaze layer, wherein the surface of the insulator is exposed so as not to be covered by the glaze layer at the maximum diameter portion.

9. The spark plug as claimed in claim 8, wherein the difference in outer diameter between the maximum diameter portion and the rear trunk portion of the insulator is less than 1 mm.

* * * * *